US012467268B2

(12) United States Patent
Watters

(10) Patent No.: US 12,467,268 B2
(45) Date of Patent: Nov. 11, 2025

(54) WALL SANDING APPARATUS

(71) Applicant: Ronald Samuel Watters, Faribault, MN (US)

(72) Inventor: Ronald Samuel Watters, Faribault, MN (US)

( * ) Notice: Subject to any disclaimer, the term of this patent is extended or adjusted under 35 U.S.C. 154(b) by 363 days.

(21) Appl. No.: 17/580,170

(22) Filed: Jan. 20, 2022

(65) Prior Publication Data

US 2023/0228104 A1 Jul. 20, 2023

(51) Int. Cl.
*E04F 21/165* (2006.01)
*B24D 15/02* (2006.01)

(52) U.S. Cl.
CPC ..... *E04F 21/1652* (2013.01); *B24D 15/023* (2013.01); *E04F 21/1655* (2013.01)

(58) Field of Classification Search
CPC . E04F 21/1652; E04F 21/165; E04F 21/1655; B24D 15/023; B24D 15/02; B24D 15/00; B24D 15/04
USPC ..... 451/344, 354
See application file for complete search history.

(56) References Cited

U.S. PATENT DOCUMENTS 2,350,574 A 6/1944 Tienken, Jr. et al.
2,749,230 A 6/1956 Kaplan
3,192,678 A * 7/1965 Buratti ..... A47L 13/11 15/244.1
4,823,515 A 4/1989 Blome
5,690,547 A 11/1997 Holland, Jr.
6,524,175 B2 2/2003 Beaudry
7,485,031 B1 * 2/2009 Stubbs ..... B24B 7/184 451/523
9,447,591 B2 9/2016 McKay
2001/0000503 A1 * 4/2001 Beaudry ..... B24D 15/023 451/523
2004/0107525 A1 * 6/2004 Newman ..... B05C 17/00 15/210.1
2006/0199484 A1 * 9/2006 Brown ..... B24D 15/04 451/523
2010/0009607 A1 * 1/2010 Rivard ..... B24D 15/023 451/356
2011/0124274 A1 * 5/2011 Field ..... B24D 15/04 451/526
2016/0361797 A1 * 12/2016 Speare ..... B24D 18/0072

FOREIGN PATENT DOCUMENTS

AU 200025207 3/2000

* cited by examiner

*Primary Examiner* — Monica S Carter
*Assistant Examiner* — Kent N Shum

(57) ABSTRACT

A wall sanding apparatus includes a plate having a top side, a bottom side, a front edge and a rear edge. An abrasive element for sanding joint compound has an upper surface that is removably attached to the bottom side and has lower surface comprising an abrasive surface. The abrasive element has a forward edge and a rearward edge respectively corresponding to the front edge and rear edge of the plate. The forward edge is adjacent to the front edge and is angled outwardly away and downwardly from the plate such that the forward edge extends forwardly of the front edge. An acute angle is formed at a juncture of the forward edge and the lower surface that is less than 75° and defines an angled edge for sanding corners of wall abutting each other to form angles of less than 180°.

14 Claims, 6 Drawing Sheets

FIG. 3
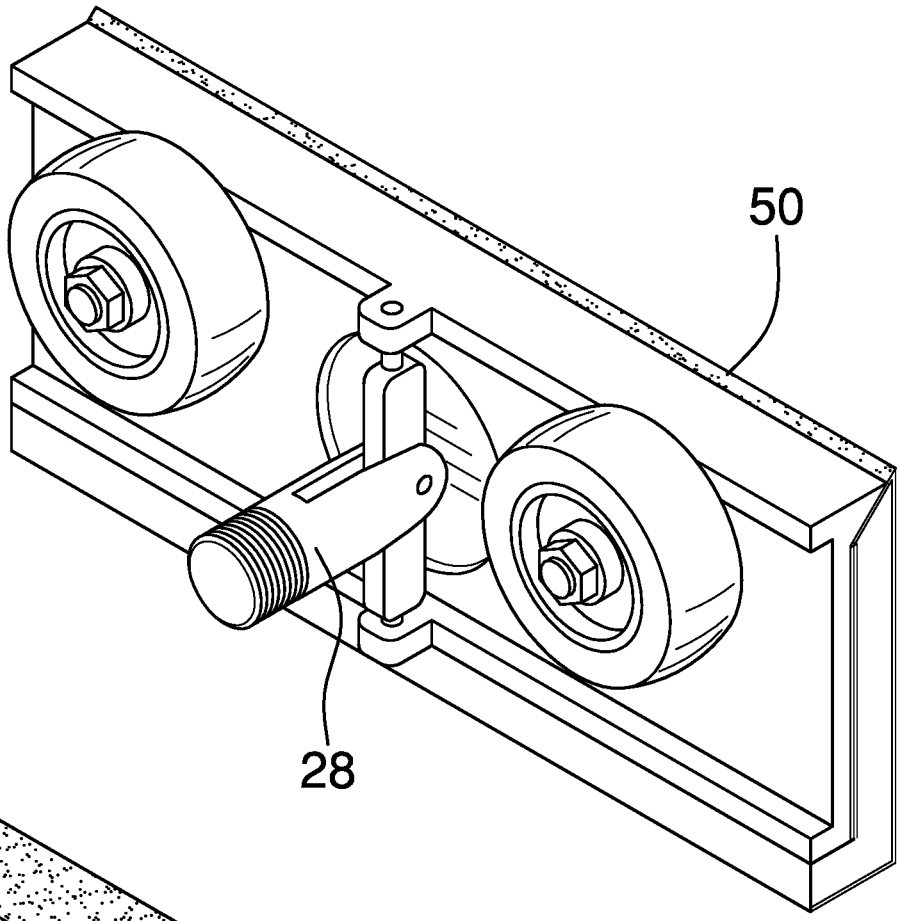
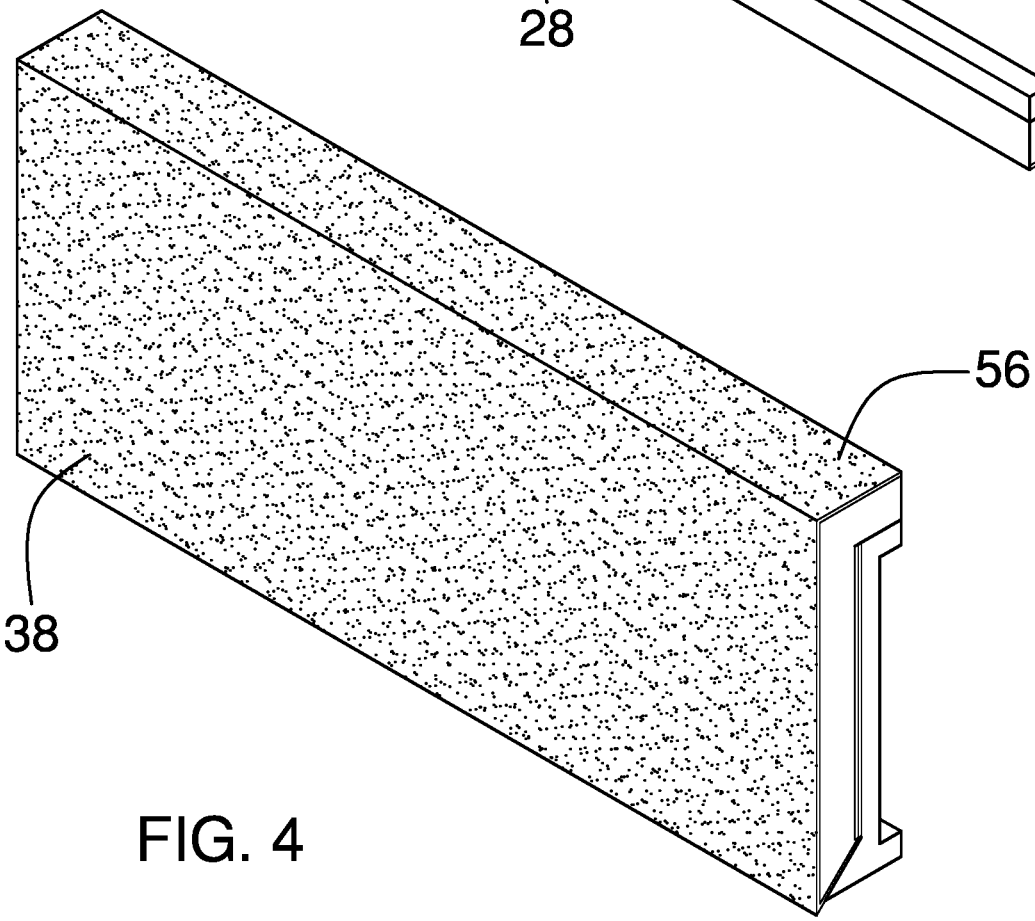
FIG. 4

WALL SANDING APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to wall sanding device and more particularly pertains to a new wall sanding device for allowing the sanding of joint compound an other non-smooth areas during wall construction and which, in particular, allows for sanding corners of walls without damaging abutting walls.

(2) Description of Related Art Including Information Disclosed Under 37 CFR 1.97 and 1.98

The prior art relates to wall sanding devices that are attached to poles or other handles and are used for sanding newly formed walls during the preparation for the addition of texture and/or paint.

BRIEF SUMMARY OF THE INVENTION

An embodiment of the disclosure meets the needs presented above by generally comprising a plate having a top side, a bottom side, a front edge, a rear edge, a first lateral edge, and a second lateral edge. A handle is engaged to the top side. An abrasive element for sanding joint compound has an upper surface that is removably attached to the bottom side and has lower surface comprising an abrasive surface facing away from the bottom side. The abrasive element substantially covers the bottom side. A coupler releasably couples the abrasive element to the bottom side. The abrasive element has a forward edge and a rearward edge respectively corresponding to the front edge and rear edge of the plate. The forward edge is adjacent to the front edge and is angled outwardly away and downwardly from the plate such that the forward edge extends forwardly of the front edge. An acute angle is formed at a juncture of the forward edge and the lower surface that is less than 75° and defines an angled edge for sanding corners of wall abutting each other to form angles of less than 180°.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 3 is a top isometric view of an embodiment of the disclosure.

FIG. 4 is a bottom isometric view of an embodiment of the disclosure.

DETAILED DESCRIPTION OF THE INVENTION

Figure 1:
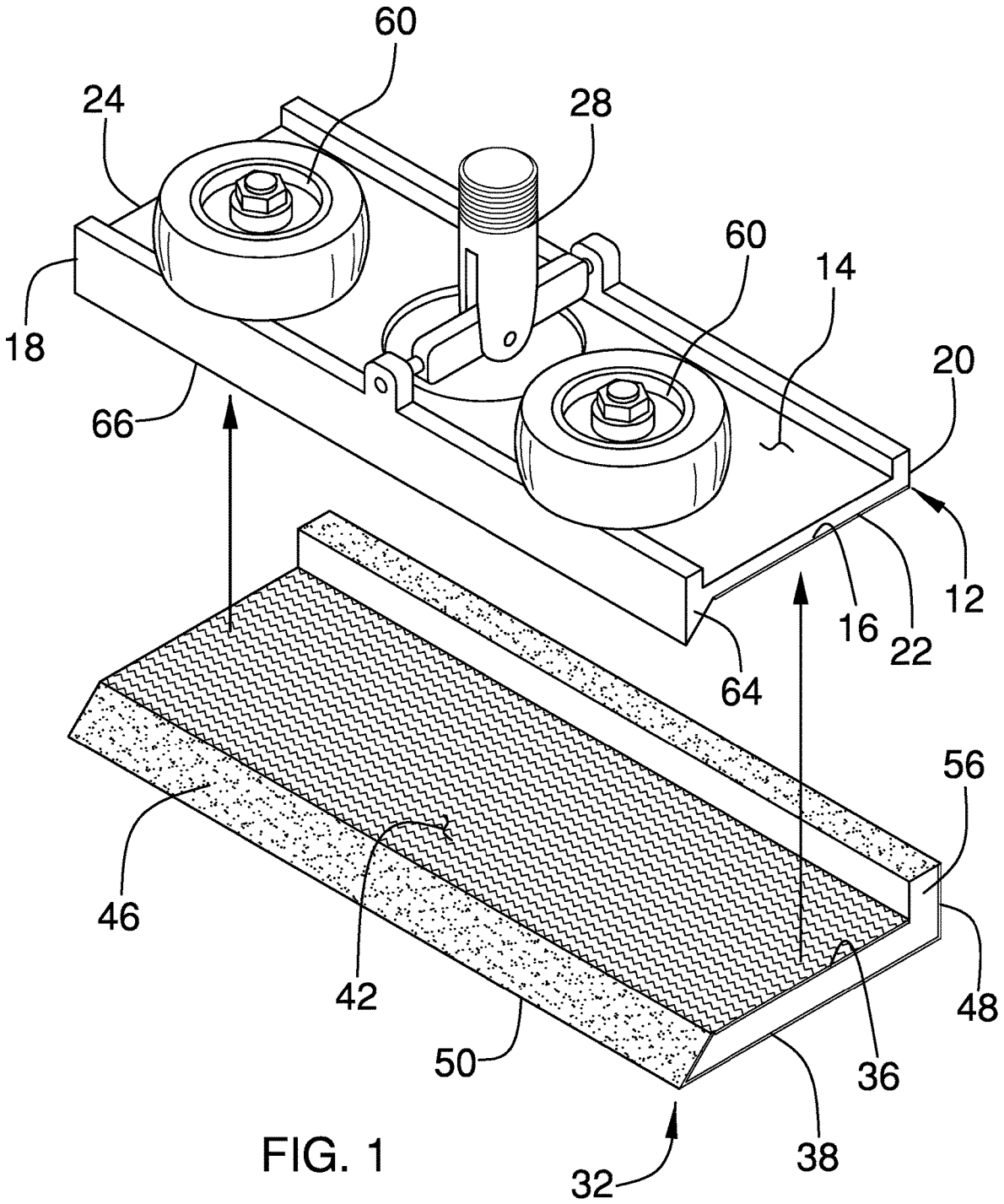
FIG. 1 is a front, top isometric view of a wall sanding apparatus according to an embodiment of the disclosure.
Figure 2:
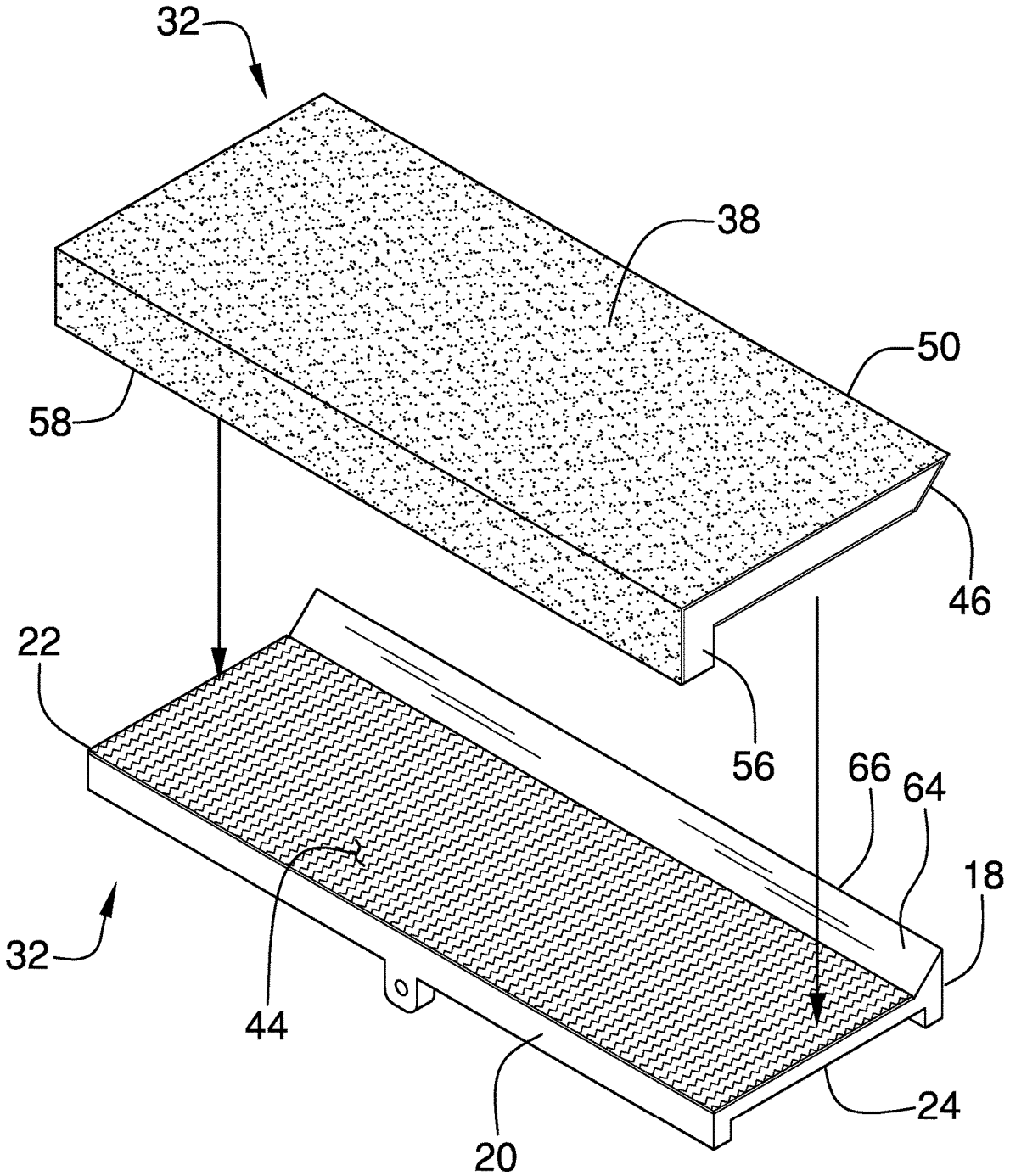
FIG. 2 is a rear, bottom isometric view of an embodiment of the disclosure.
Figure 5:
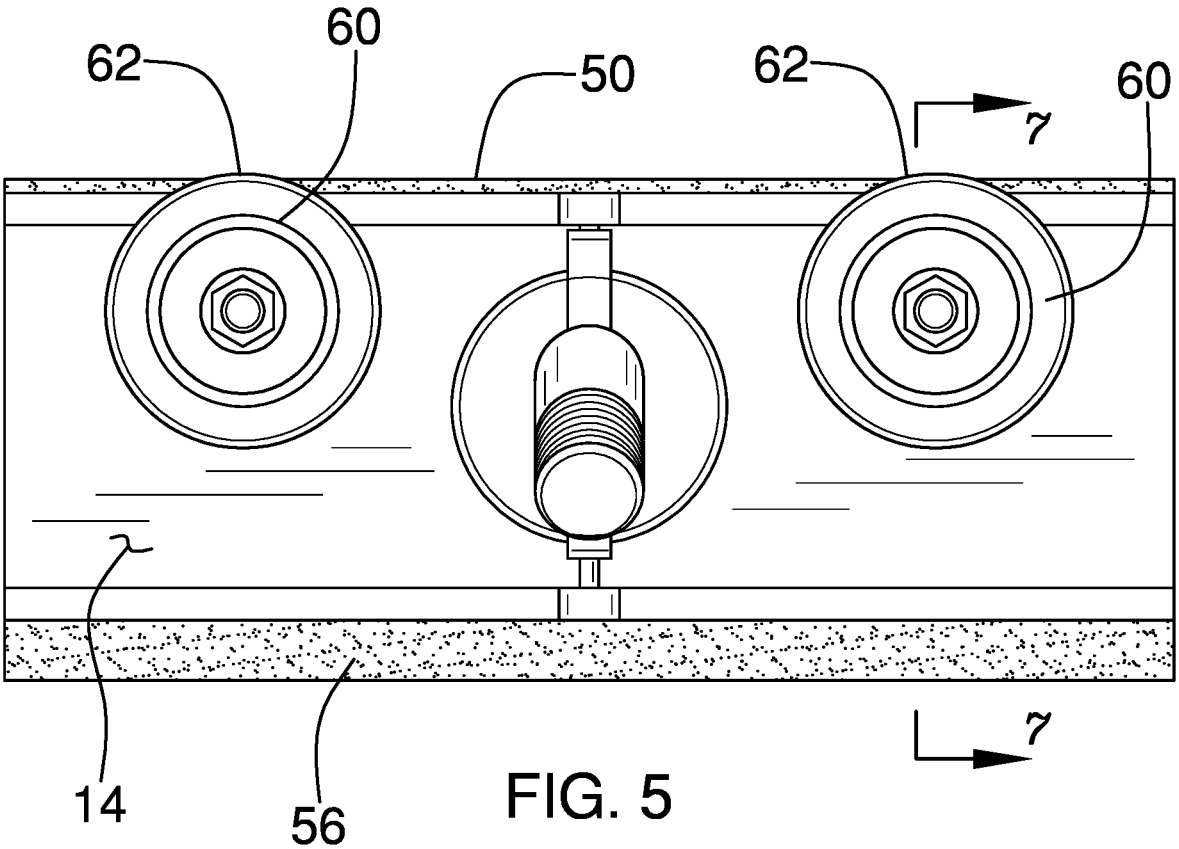
FIG. 5 is a top view of an embodiment of the disclosure.
Figure 6:
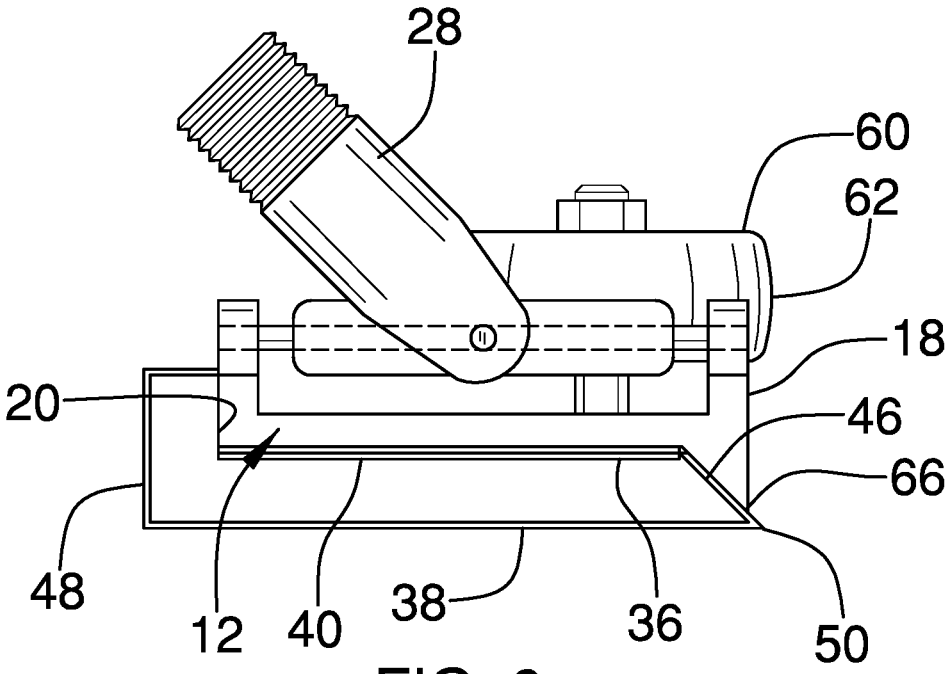
FIG. 6 is a side view of an embodiment of the disclosure.

With reference now to the drawings, and in particular to FIGS. 1 through 8 thereof, a new wall sanding device embodying the principles and concepts of an embodiment of the disclosure and generally designated by the reference numeral 10 will be described.

As best illustrated in FIGS. 1 through 8, the wall sanding apparatus 10 generally comprises a plate 12 having a top side 14, a bottom side 16, a front edge 18, a rear edge 20, a first lateral edge 22 and a second lateral edge 24. The top side 14 may have any useful size but typically will have a length and width each being between 3.0 inches and 18.0 inches. The top side 14 is typically planar though its shape is not germane to its function and therefore the term "planar" when used herein as referencing the plate 12 may refer to the top side 14 or a plane that extends through and is continuous with a peripheral edge of the plate 12.

A handle 26 is engaged to the top side 14. In one embodiment, the handle 26 includes a connector 28 pivotally coupled to the top side 14 and a grip 30 is removably attached to the connector 28. The connector 28, as can be seen in FIG. 3, may be pivotable about two axis. The grip 30 shown in FIG. 8 includes an elongated pole. The grip 30 and connector 28 may include a threaded connection as is often utilized with work tools which include an elongated pole. It should be understood that different types of handles 26, such as those that extend no more than a few inches from the plate 12 and are to be used with a single hand to form a handhold for the user may also be utilized.

An abrasive element 32 configured to sand joint compound positioned on a wall 34 has an upper surface 36 that is removably attached to the bottom side 16 and has lower surface 38 comprising an abrasive surface facing away from the bottom side 16. The abrasive element substantially covers the bottom side 16 and the abrasive element 32 comprises a resiliently compressible material. Such sanding materials are conventional and typically include a foamed elastomeric material coated in an abrasive of granular material wherein the particles of the granular material are sized depending on the needs of the person performing the sanding task.

A coupler 40 releasably couples the abrasive element 32 to the bottom side 16. The coupler 40 includes a first mating member 42 attached to the abrasive element 32 and a second mating member 42 attached to the bottom side 16. The first 42 and second 44 mating members are releasably engaged with each other. In some embodiments, as shown in the Figures, the first and second mating members comprise hook and loop mating members. Alternative attachment means may include snaps, magnets, releasable adhesives and the like.

The abrasive element 32 has a forward edge 46 and a rearward edge 48 corresponding, respectively, to the front edge 18 and that rear edge 20 when the abrasive element 32 is positioned on the plate 12. The forward edge 46 is adjacent to the front edge 18 and is angled outwardly away and downwardly from the plate 12 such that the forward edge 46 extends forwardly of the front edge 18. An acute angle formed at a juncture of the forward edge 46 and the lower surface 38 is less than 75°, and typically no greater than 60°, to define an angled edge 50. This allows the abrasive element 32 to better engage and sand adjacent to interior corners 52, i.e. corners of less than 180° such as where a ceiling meets a wall and where two wall surfaces meet. The angled edge 50 will also allow for sanding the corners 52 as well. Typically, the forward edge 46 also includes the abrasive surface.

The rearward edge 48 extends rearwardly beyond the rear edge 20 of the plate 12 wherein a distance from the rearward edge 48 to the angled edge 50 is greater than a distance from the front edge 18 to the rear edge 20. This ensures that while a person is using the system 10, the front 18 and rear 20 edges of the plate 12 will not abut and mar an adjacent wall surface 54, that is perpendicular to the wall 34 being sanded, since the abrasive element 32 will first contact the adjacent wall surface 54 before the adjacent wall surface 54 will contact the abrasive element 32.

A flange 56 is attached to and extends upwardly from the upper surface 36 and the rearward edge 48. The flange 56 abuts the rear edge 20 of the of the plate 12. The flange 56 is co-extensive with the rearward edge 48 and has an outer surface 58 that is co-planar with the rearward edge 48. The outer surface 58 includes the abrasive surface and allows for sanding the adjacent wall surface 54, particularly when used in a corner 52 of two walls. The flange 56 forms a unitary structure with the abrasive element 32.

Figure 7:
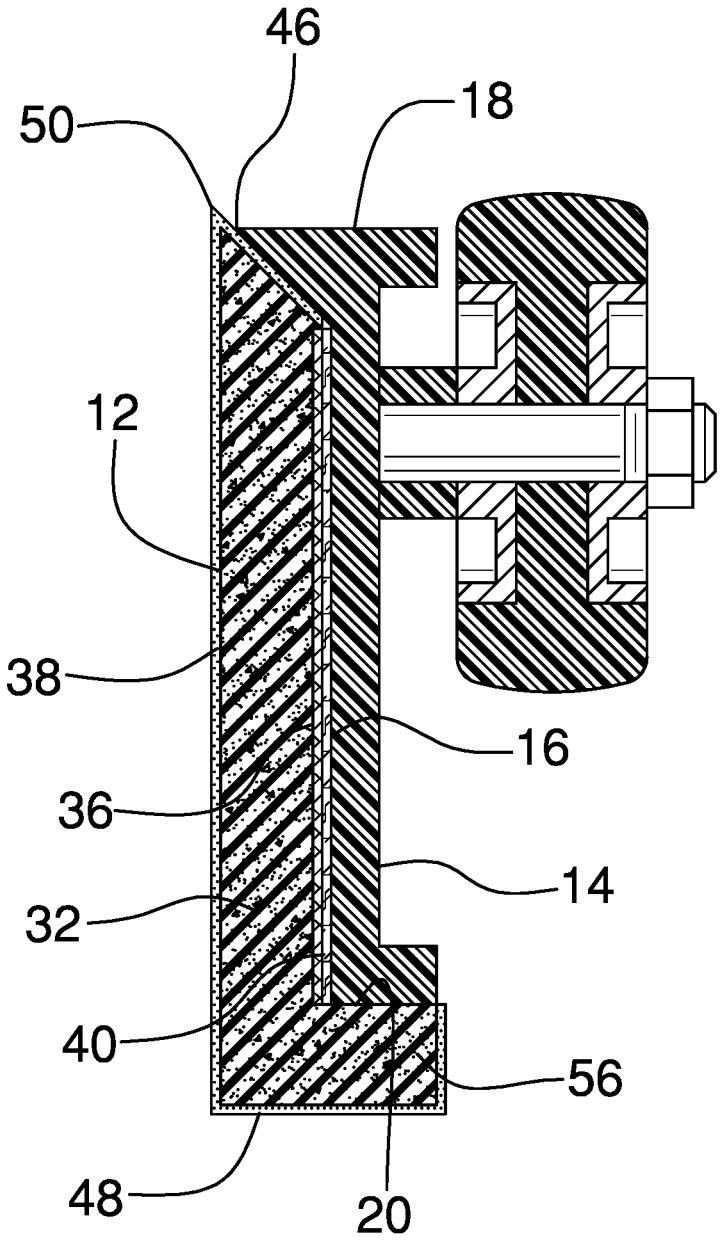
FIG. 7 is a cross-sectional view of an embodiment of the disclosure taken along line 7-7 of FIG. 5.
Figure 8:
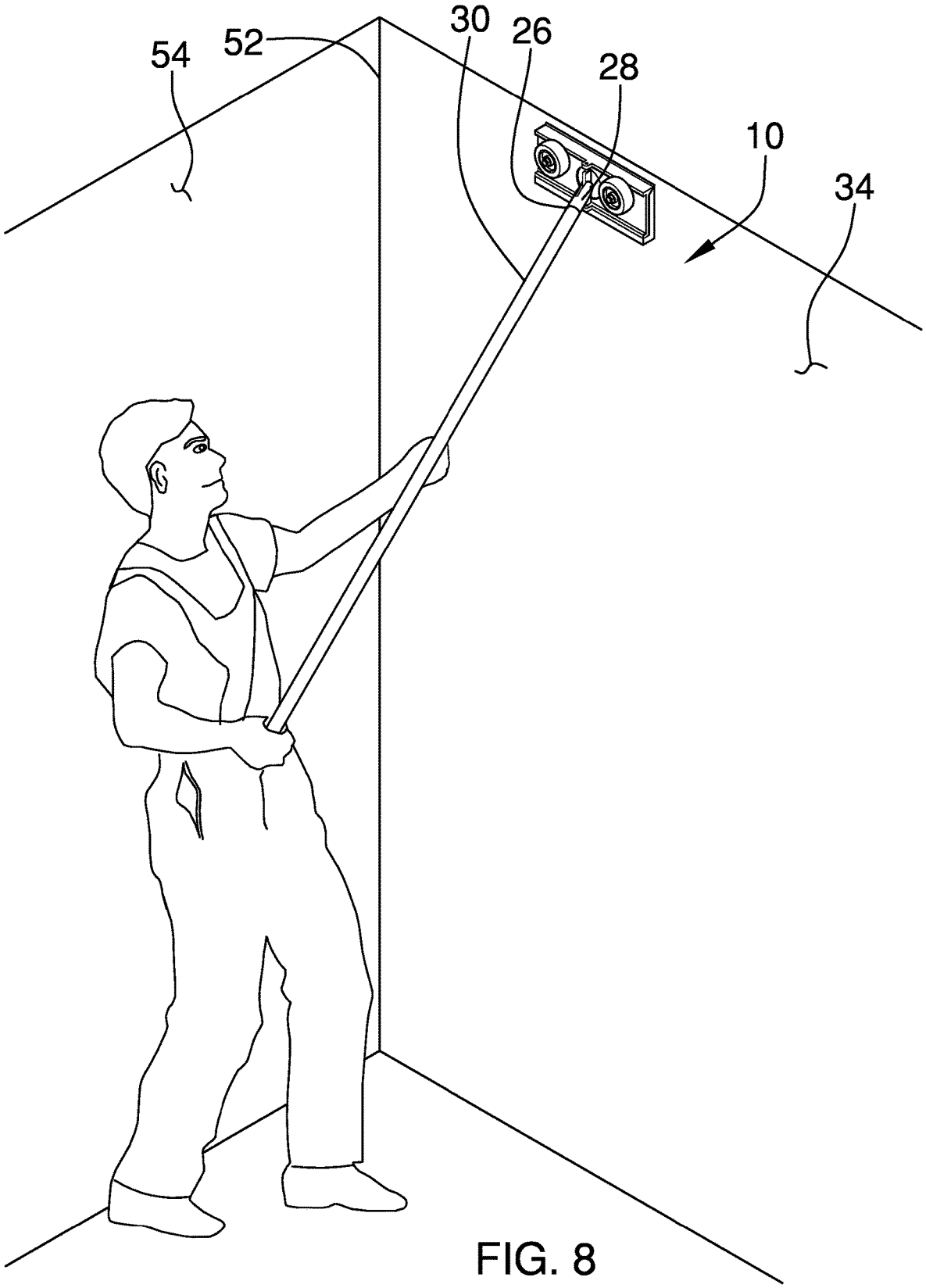
FIG. 8 is an isometric in-use view of an embodiment of the disclosure.

A pair of rollers 60 is rotatable mounted to the top side 14 of the plate 12. The rollers 60 each have an axis of rotation orientated perpendicular to a plane of the top side 14. More particularly, each of the rollers 60 has a perimeter edge 62 wherein the perimeter edges 62 of the rollers 60 extend further forward of the plate 12, relative to the rear edge 20, than a juncture of the bottom side 16 and the front edge 18 such that the perimeter edges 62 of the rollers 60 prevent abutment of the front edge 18 with a wall orientated perpendicular to the plane of the top side 14. As can be seen in FIG. 7, the perimeter edge 62 may extend beyond the angled edge 50, however, this positioning is not required since the angled edge 50 may extend further outwardly, relative to the rear edge 20, than the perimeter edge 62. Essentially, the purpose of the rollers 60 is to prevent marring of a wall surface caused by the front edge 18 being rubbed against the wall surface.

A biasing member 64 is attached to the bottom side 16 and extends along the front edge 20. The biasing member 64 matches a contour of the forward edge 46 and abuts the forward edge 46 of the abrasive element 32. The biasing member 64 extends from a juncture of the upper surface 36 toward the angled edge 50 and is spaced from the angled edge 50. The biasing member 64 most typically forms a unitary structure with the plate 12. Because the biasing member 64 matches the contour of the forward edge 46, it includes an elongated edge 66, forming an angle of less than 75° and more typically no greater than 60°, that downwardly extends and is coextensive with the forward edge 46 when the abrasive member 32 is mounted on the plate 12. The elongated edge 66 prevents the forward edge 46 from buckling when the angled edge 50 is positioned in a corner 52 of two adjoining walls 34, 54. Thus, the abrasive member 32 retains a "pointed edge" for sanding the corner 52 itself.

In use, the abrasive element 32 is selected for its abrasive properties and attached to the plate 12 as described above and shown in the Figures. The abrasive element 32 is then used to sand areas of sheet rock, after installation to form a wall, where the wall is not smooth due to joints, fasteners and the like which have been covered by joint compound. The angled edge 50 allows a user to easily sand up to and within corners 52 while the rollers 60 prevent marring of walls which might otherwise occur due to the plate 12 being rubbed against the walls during the sanding process.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sanding system for sanding joint compound, the system including:

a plate having a top side, a bottom side, a front edge, a rear edge, a first lateral edge and a second lateral edge, the plate having a lip extending from the top side along the rear edge;

a handle being engaged to the top side;

an abrasive element configured to sand the joint compound having an upper surface being removably attached to the bottom side and having a lower surface comprising an abrasive surface facing away from the bottom side, the abrasive element substantially covering the bottom side;

a coupler releasably coupling the abrasive element to the bottom side; and the abrasive element having a forward edge and a rearward edge respectively corresponding to the front edge and rear edge, the forward edge being adjacent to the front edge, the forward edge being angled outwardly away and downwardly from the plate such that the forward edge extends forwardly of the front edge, an acute angle being formed at a juncture of the forward edge and the lower surface being less than 75° and defining an angled edge;

wherein the rearward edge extends rearwardly beyond the rear edge of the plate wherein a distance from the rearward edge to the angled edge is greater than a distance from the front edge to the rear edge; and a flange, the flange being planar and being attached to and extending upwardly and perpendicularly from the upper surface and the rearward edge, the flange abutting the rear edge of the plate and being coextensive with the lip such that a top surface of the flange is coplanar with and extends away from the rear edge of the plate.

2. The sanding system for sanding joint compound according to claim 1, wherein the handle includes a connector pivotally coupled to the top side and a grip being removably attached to the connector, the grip comprising an elongated pole.

3. The sanding system for sanding joint compound according to claim 2, further including a pair of rollers being rotatable mounted to the top side of the plate, the rollers each having an axis of rotation orientated perpendicular to a plane of the top side, each of the rollers having a perimeter edge, the perimeter edges of the rollers extending further forward of the plate relative to the rear edge than a juncture of the bottom side and the front edge such that the perimeter edge prevents abutment of the front edge with a wall orientated perpendicular to the plane of the top side.

4. The sanding system for sanding joint compound according to claim 1, wherein the abrasive element comprises a resiliently compressible material.

5. The sanding system for sanding joint compound according to claim 1, further including the coupler comprising a first mating member attached to the abrasive element and a second mating member attached to the bottom side, the first and second mating members being releasably engaged with each other.

6. The sanding system for sanding joint compound according to claim 5, wherein the first and second mating members comprise hook and loop mating members.

7. The sanding system for sanding joint compound according to claim 1, wherein the forward edge comprises the abrasive surface.

8. The sanding system for sanding joint compound according to claim 1, wherein the flange is co-extensive with the rearward edge such that the flange and the rearward edge have an equivalent length.

9. The sanding system for sanding joint compound according to claim 8, wherein the flange has an outer surface being co-planar with the rearward edge, the outer surface comprising the abrasive surface, the flange forming a unitary structure with the abrasive element.

10. The sanding system for sanding joint compound according to claim 9, further including a pair of rollers being rotatable mounted to the top side of the plate, the rollers each having an axis of rotation orientated perpendicular to a plane of the top side, each of the rollers having a perimeter edge, the perimeter edges of the rollers extending further forward of the plate relative to the rear edge than a juncture of the bottom side and the front edge such that the perimeter edge prevents abutment of the front edge with a wall orientated perpendicular to the plane of the top side.

11. The sanding system for sanding joint compound according to claim 10, further including a biasing member being attached to the bottom side and extending along the front edge, the biasing member matching a contour of the forward edge of the abrasive element and abutting the forward edge, the biasing member extending from a juncture of the upper surface toward the angled edge and being spaced from the angled edge, the biasing member forming a unitary structure with the plate.

12. The sanding system for sanding joint compound according to claim 11, wherein the handle includes a connector pivotally coupled to the top side and a grip being removably attached to the connector, the grip comprising an elongated pole.

13. The sanding system for sanding joint compound according to claim 12, wherein the abrasive element comprises a resiliently compressible material.

14. The sanding system for sanding joint compound according to claim 1, further including a biasing member being attached to the bottom side and extending along the front edge to prevent buckling of the front edge when the front edge is used for sanding, the biasing member engaging the front edge between the upper surface and the angled edge of the abrasive member.

* * * * *